United States Patent [19]

Grabovac

[11] Patent Number: 4,532,836

[45] Date of Patent: Aug. 6, 1985

[54] ADJUSTABLE FULCRUM FOR TORQUE WRENCHES

[75] Inventor: Bosko Grabovac, Arcadia, Calif.

[73] Assignee: Consolidated Devices, Inc., City of Industry, Calif.

[21] Appl. No.: 516,778

[22] Filed: Jul. 25, 1983

[51] Int. Cl.[3] ..... B25B 23/14

[52] U.S. Cl. ..... 81/483

[58] Field of Search ..... 81/483, 478

[56] References Cited

U.S. PATENT DOCUMENTS 3,772,942 11/1973 Grabovac ..... 81/483

4,207,783 6/1980 Grabovac ..... 81/483

*Primary Examiner*—James L. Jones, Jr.

*Attorney, Agent, or Firm*—Georges A. Maxwell

[57] ABSTRACT

An adjustable click-type torque wrench comprising an elongate, tubular arm with front and rear ends, a work-engaging head on an axis normal to the axis of the arm, an elongate link projecting rearwardly from the head and freely into the arm, a first pivot means connecting the front end portion of the lever to the front end portion of the arm on an axis parallel with the axis of the head, an elongate link with front and rear ends within the arm, a second pivot means connecting the front end of the link to the rear end of the lever on an axis parallel with the first pivot means, an elongate annular fulcrum block engaged about the link between the ends thereof and shiftable circumferentially and longitudinally relative thereto and having an annular outwardly disposed bearing surface with diametrically opposite work load transmitting sides engaging diametrically opposite sides of the interior surface of the arm on a central radial plane of the link which is normal to the axis of said pins, the central axis of the annular bearing surface is angularly related to the central axis of the link, lock means releasably locking the block in set longitudinal and circumferential position on the link, a plunger in the arm rearward from the link, a cam block with flat faces normally in flat engagement with opposing cam seats on the link and plunger and spring means yieldingly urging the plunger forward, the position of the diametrically opposite work load transmitting portions of the bearing surface are moved longitudinally relative to the link, arm and to each other by circumferential movement of the block on the link.

6 Claims, 8 Drawing Figures

ADJUSTABLE FULCRUM FOR TORQUE WRENCHES

This invention has to do with an adjustable fulcrum for torque wrenches.

BACKGROUND OF THE INVENTION

The art of click-type adjustable torque wrenches is old and highly developed. Such wrenches typically include elongate tubular lever arms with front and rear ends, manually engageable handles at the rear ends of the arms, and work engaging heads at the front ends of the arms. The work engaging heads have elongate polygonal parts with central axes normal to the longitudinal axes of the arms. The noted polygonal parts of the heads are provided to drivingly engage and carry drive sockets and the like to couple the wrench with a screw fastener or the like. The heads also have elongate rearwardly projecting levers that project freely rearwardly into and through the forward portions of the arms. The forward end portions of the levers are pivotally connected to the front end portions of the arms by pivot pins spaced rearward from and parallel with the axes of the heads and normal to the axes of the arms so that the levers can pivot laterally and into stopped engagement with the interior surfaces of the arms when the heads are drivingly coupled with a piece of work to be torqued and the arms are manually pivoted about the axes of the heads.

The rear ends of the levers have rearwardly disposed flat cam seats. The arms carry longitudinally shiftable plungers with flat forwardly disposed cam seats spaced from and opposing the cam seats on the levers. Cam blocks, with flat forwardly and rearwardly disposed cam faces are engaged between the noted cam seats and normally establish seated engagement therewith. Compression springs are engaged in the arms rearward of the plungers to engage and urge the plungers forward so that the cam faces of the cam blocks cooperate with their related cam seats to releasably hold the levers central and in axial alignment with the axes of the arms. Means are provided to adjust the axial biasing of and pressure exerted by the springs onto and through their related plungers, cam blocks and levers. The forces exerted by the springs determine the turning force which must be applied onto and through the wrench structures to cause the levers to overcome the holding force afforded by the cam blocks between the plungers and levers and to allow the levers to pivot within the arms. When sufficient force is directed through and between the arms and levers to cause the levers to pivot in the arms, the cam blocks are caused to pivot between the plungers and levers, the plungers shift rearwardly against the resistance of the springs and the levers pivot laterally and strike the inside surfaces of the arms, generating an audible click sound.

In the art of click-type adjustable torque wrenches of the general character referred to above, there is another more sophisticated and improved wrench structure which, in addition to the structure noted above, includes an elongate link with front and rear ends positioned in the wrench arm between the lever and the plunger. The front end of the link is pivotally connected with the rear end of the lever by a pivot pin on an axis parallel with and spaced rearward from the pivotal axis of the lever. The rear end of the link is formed with the rearwardly disposed cam seat which opposes and normally establishes flat engagement on the front cam surface of the cam block. The link is pivotally supported between its ends and within the arm by a fulcrum block which is carried by the link and engages the interior surface of the arm. When the arm and lever pivot, that is, when the rear end of the lever is caused to move laterally to one side or the other of the arm, the front end of the link moves laterally with it, pivoting the link about the turning axis of the fulcrum block. Upon such pivoting or turning of the link, the rear end thereof moves laterally to the other side of the arm. The rear end of the link cooperates with the cam block and plunger in the same manner that the levers, cam block and plungers of the first described form of torque wrench cooperate.

The fulcrum block in the second form of adjustable torque wrench is shiftable longitudinally on its related link and is releasably secured in stationary position therein by a set screw. The set screw is accessible through an opening in the side of the arm.

The above noted link affords a mechanical advantage for the spring of the wrench whereby the spring need not be overworked and whereby a lighter, more durable spring can be employed. Further, by adjusting the longitudinal position of the fulcrum on the link, accurate adjustments compensating for mechanical or structural deviations, which effect operation of the wrench can be made. For example, if the spring is too strong or too weak, the fulcrum block can be adjusted longitudinally of the link to compensate for the error in the strength of the spring.

The above and last noted wrench structure is the subject matter of and is fully disclosed in my U.S. Pat. No. 3,772,942 for "IMPROVED ADJUSTABLE TORQUE WRENCH" and issued Nov. 20, 1973. Wrenches of the type or class considered above are intended and designed to operate accurately in clockwise and counter-clockwise directions. In practice, however, such wrenches are seldom sym metrical, that is, they seldom work accurately in both directions. As a general rule, in prior art wrenches provided to operate through a range of from 0 to 150 ft. pounds of force, it can be anticipated that the operating force required to operate them in one direction is likely to be as much as 10 or 15 pounds different than the operating force required to operate them in the other or opposite direction. A 10 to 15 pound differential, while clearly unsatisfactory or excessive, has, as a practical manner, been considered acceptable since the prior art has failed to provide any means for correcting such deviations.

The noted deviations or errors between clockwise and counter-clockwise operation in such wrenches is often the result of the cumulative effect of the necessary tolerances in size and/or shape of parts and of necessary working tolerances between those parts. It has been determined that to establish prior art wrench structures so that they are symmetrical and operate accurately in both clockwise and counter-clockwise directions, extraordinary and excessively costly quality control procedures would have to be established and practiced and parts of the resulting wrench structures would have to be so closely fitted that normally encountered changes in temperatures and resulting thermal expansion and contraction of the parts would likely result in binding and/or freezing of the parts and render the wrenches inoperative.

OBJECTS AND FEATURES OF THE INVENTION

It is an object of my invention to provide an improved adjustable click-type torque wrench structure which operates accurately in both clockwise and counter-clockwise direction.

An object and feature of my invention is to provide an adjustable click-type wrench structure of the class referred to above which includes an elongate link between the lever and cam block of the wrench, which link is pivotally supported between its ends by a fulcrum structure with pivot edges at opposite sides of the link to engage the interior surface of the wrench arm, at opposite sides thereof; and a fulcrum structure wherein the position of the pivot edges can be shifted and set longitudinally of the arm and the link and relative to each other to balance and/or equalize operation of the wrench when operated in clockwise and counter-clockwise directions.

It is an object and feature of my invention to provide an improved wrench structure of the general character referred to which is such that it can be made to operate accurately in both clockwise and counter-clockwise directions without increasing and to some extent, decreasing the quality control standards, with respect to tolerances, which are required to be practiced in the establishment of click-type torque wrench structures provided by the prior art.

The foregoing and other objects and features of my invention will be aparent and fully understood from the following detailed description of typical preferred forms and embodiments of the invention, throughout which description reference is made to the accompanying drawings.

DETAILED DESCRIPTION OF THE INVENTION

Figure 1:
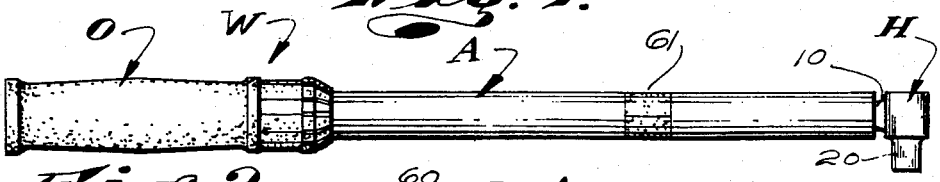
FIG. 1 is a side elevational view of a wrench embodying my invention.

The wrench structure W that I provide and which is illustrated in the drawings is, but for the nature and form of the fulcrum block B (which will be described in detail in the following) is the same as that wrench which is the subject matter of and fully disclosed in my U.S. Pat. No. 3,772,942, issued Nov. 20, 1973. The noted patented wrench structure has been continuously produced and successfully commercially exploited since prior to the issuance of the above noted patent to this date and is well known, with respect to its construction and operation, to all of those who are skilled in the art of torque wrenches. Accordingly, I will limit the following description of the parts and portions of the wrench structure W which constitute prior art, to a general description of those parts and portions and direct attention to the above identified U.S. Pat. No. 3,772,942 for a more detailed description thereof, if required.

The wrench W includes an elongate tubular arm A with a front end 10 and a rear end. The rear end of the arm is provided with and carries a manually engageable hand grip O.

The wrench W next includes a work engaging head H adjacent the front end of the arm A. The head H is an elongate part with a central axis which is normal to the axis of the arm A and which has a polygonal portion 20 to releasably drivingly engage and carry drive sockets or the like to drivingly couple the head H with screw fastener parts and the like (not shown).

The head H includes or is fixed to and carried by the front end of an elongate crank arm or lever C which projects rearwardly from the head and freely into and through the front end portion of the arm A. The front end portion of the lever C is pivotally connected to the front end portion of the arm A by a pivot pin P engaged in and through registering openings 18 and 19 in the lever and the arm. The axis of the pin is parallel with and spaced rearward from the axis of the head.

The rear end portion of the arm is formed with a rearwardly opening slot-like or socket-like opening 16 to accommodate the front end of a related link L.

The link L is an elongate part with front and rear ends and is freely positioned within the arm A, rearward of the lever C. The front end portion of the link enters the opening 16 in the rear end of the lever C and is pivotally connected thereto by a pivot pin P′ engaged in and through registering openings in the lever and the link. The axis of the pin P′ is parallel with and spaced rearward from the axis of the pin P.

The rear end of the link is formed with a flat, normally rearwardly disposed front cam seat F.

The link is pivotally supported between its front and rear ends by the above referred to fulcrum block B, the details of which will be described in detail in the following.

The wrench W next includes an elongate cylindrical plunger D in rearward spaced relationship from the rear end of the link L. The front end of the plunger D is formed with a flat forwardly disposed rear cam seat R.

The wrench W next includes a cam block E with flat, normally forwardly and rearwardly disposed front and rear cam faces normally establishing flat bearing engagement on and with their opposing front and rear cam seats F and R, on the link L and plunger D.

The wrench structure W next includes an elongate helical compression spring S in the arm A rearward of and engaging the plunger D to normally yieldingly urge the plunger D forwardly toward the rear end of the link L, with the front and rear cam faces of the cam block E firmly held in flat seated engagement with the cam seats F and R.

The wrench W also includes operating means (not shown) at and within the rear portion of the arm A and engaging the rear end of the spring S to vary axial compression or biasing of the spring S and to set the forces directed axially through and between the plunger D, cam block E and link L. In accordance with common practice, the hand grip O is a part of the referred to operating means and is such that when manually turned relative to the arm A, a screw part coupled therewith and within the arm is turned to adjust the biasing of and force exerted by the spring S. The extent to which the spring is biased determines the operating force of the wrench and the operating means can, in accordance with common practice, include calibrated means which effectively translates the extent to which the spring is biased to indicate the corresponding operating force of the wrench.

Since the above noted operating means can vary widely without in any way affecting or departing from the spirit of my invention, I have elected not to unduly burden this disclosure with detailed illustration and description thereof.

The wrench structure W illustrated in the drawings and thus far described is substantially identical with the prior art wrench structure disclosed in detail in U.S. Pat. No. 3,772,942.

The only substantial differences between the noted patented wrench and the wrench of the present invention resides in the details, and function of the above referred to fulcrum block B.

(The fulcrum block in the noted patented wrench is an elongate sleeve slidably engaged on and about the link and formed with a semi-spherical exterior bearing surface which establishes universal pivoting and sliding bearing engagement with the interior of the arm. The semi-spherical exterior bearing surface is geometrically symmetrical and non-variable).

The fulcrum block B that I provide is an elongate annular or tubular part with a central opening 50 in and through which the link L is slidably engaged. The block B is formed with an annular radially outwardly opening annular groove 51 between its ends. The end portions of the block extending from opposite sides of the groove 51 are tapered longitudinally outwardly and radially inwardly, as indicated at 52 and 53. The end portion 53 is formed with an internally threaded radially extending opening 54 in which an Allen set screw 55 is engaged. The set screw 55 engages the link L and releasably locks the block B in desired set rotative and longitudinal position on the link L.

An important and novel feature of the block B is the groove 51 is on a radial plane which is out of parallel with the radial planes of the block B and link L through which the groove extends. Otherwise stated or defined, the central axis of the groove is non-parallel with and is angularly related to the central axes of the block and link. In the form of the invention illustrated, the radial planes of the block and groove or the central axes of the block and groove are angularly related at 5°. The angular displacement can be made greater or less, as circumstances require.

In addition to the above, the block B includes or carries an annular snap-ring type bearing ring 56 set in and projecting radially outward from the groove 51. The bearing ring 56 establishes sliding bearing engagement on and with the interior surface of the arm A.

Figure 8:
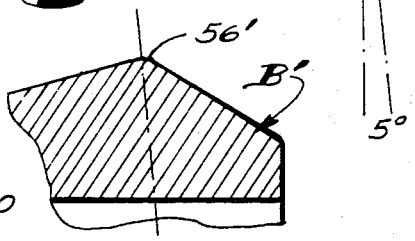
FIG. 8 is a view similar to FIG. 7 showing another embodiment of the invention.

In practice, and as shown in FIG. 8 of the drawings, the block B′ can be machined to form an annular bearing surface or edge 56′ which is the full equivalent of the bearing surface established by the ring 56, without departing from the broader aspects and spirit of my invention. In accordance with the above, the ring 56 can be and will be called a "bearing surface" for the purpose of this disclosure.

It is to be noted that in operation, the sides or portions of the bearing ring or bearing surface 56 which occur at diametrically opposite sides of the link L on the central radial planes of the link and block which are normal to the axes of the pivot pins P and P′ are the sides or portions of the bearing surface 56 which establish pressure or load bearing contact with the interior surface of the arm A when the wrench is operated. The load bearing sides or portions of the bearing surface 56 are identified by the reference characters X and Y in the drawings. The other sides and/or portions of the bearing surface 56 only serve to normally maintain the block B and link L substantially centrally oriented within the arm A and are not load bearing surfaces.

It is to be noted that due to the angular disposition of the bearing surface 56 relative to the axes of the block and link, upon rotating the block on the link to an intermediate or mean rotative position, the diametrically opposite load bearing portions X and Y of the surface 56 occur at diametric opposite sides of the link and block and engage diametric opposite sides of the inside surface of arm A. When the block is thus positioned and set, the wrench structure is theoretically symmetrical or balanced and is such that it will operate both clockwise and counter-clockwise under identical applied working or operating forces. However, as previously noted, due to working tolerances and the like, such symmetry or balance is often unattained and the clockwise and counter-clockwise operating forces are dissimilar. When the two noted operating forces are dissimilar, the block B is rotated clockwise or counter-clockwise relative to the link causing the resulting bearing portions X and Y of the surface 56 to move axially in opposite directions relative to the longitudinal axis of the link and the arm. Thus, the mechanical advantage afforded by the link in clockwise operation of the wrench is increased or decreased and the mechanical advantage afforded by the link in counter-clockwise operation of the wrench is decreased or increased, correspondingly. By such rotation of the block on the link and resulting longitudinal shifting of the bearing portions X and Y of the bearing surface 56, differences in clockwise and counter-clockwise operating forces can be effectively compensated for and those different operating forces can be effectively brought into balance.

To attain maximum relative longitudinal shifting and setting of the bearing portions X and Y of the surface 56, the block B need only be shifted or rotated circumferentially 45° from its normal position, in a clockwise or counter-clockwise direction, as circumstances require.

Figure 6:
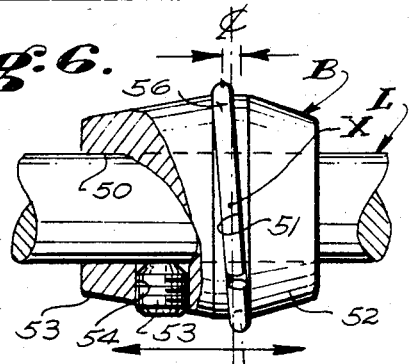
FIG. 6 is a view taken substantially as indicated by line 6—6, rotated and with portions broken away to better illustrate the invention.
Figure 7:
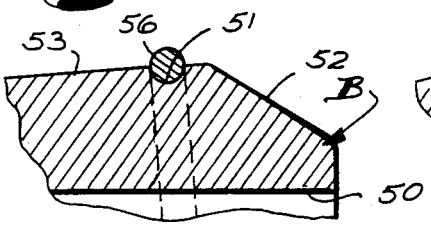
FIG. 7 is an enlarged detailed sectional view of a portion of the structure shown on FIG. 6.

In the case illustrated, rotating the block B 45° from its normal position alters or varies the relative longitudinal spacing of the bearing portions X and Y that distance indicated at V in FIG. 6 of the drawings.

In practice, the extent to which the block B must be rotated to balance the wrench structure is seldom more than 10° in one direction or the other from normal. If it is necessary that the block be turned more than 10°, the cause of the deviation in operating forces can be attributable to the existence of some major fault or error in the wrench structure and the wrench, as a whole, is defective and should be rejected.

In furtherance of my invention, the block B is shifted longitudinally forwardly and rearwardly of the link L to increase and decrease the lengths of the forward and rear portions of the link which project from opposite ends of the fulcrum block E and to thereby change or adjust the mechanical advantage afforded by the link in the wrench structure. By adjusting the longitudinal positioning of the block, the wrench can be adjusted to compensate for those variables which would otherwise result in inaccurate operation of the wrench. In practice, slight longitudinal movement of the block on the link results in substantial changes in the operating forces of the wrench. Accordingly, required movement of the block is generally very short.

Figure 2:
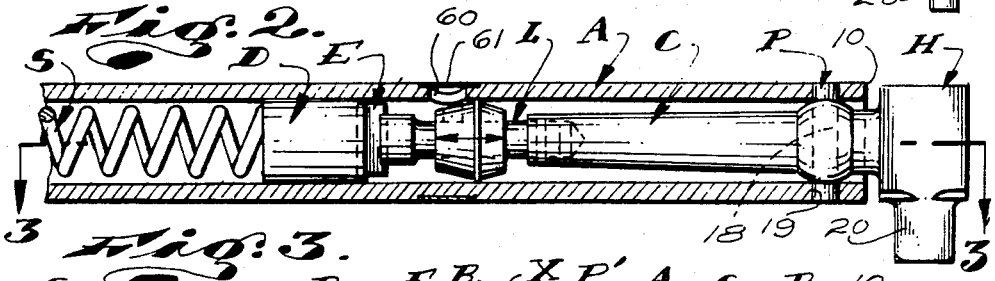
FIG. 2 is an enlarged sectional view of a wrench shown on FIG. 1.
Figure 3:
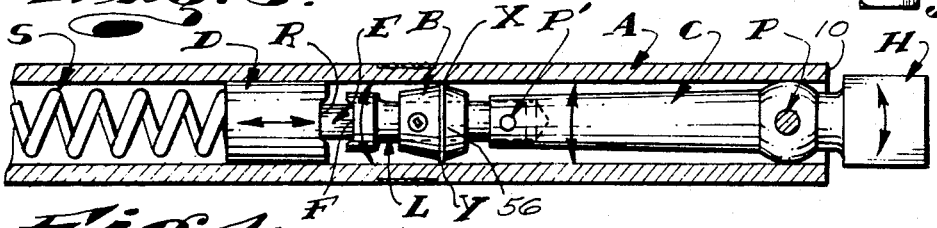
FIG. 3 is a view taken substantially as indicated by line 3—3 on FIG. 2.
Figure 4:
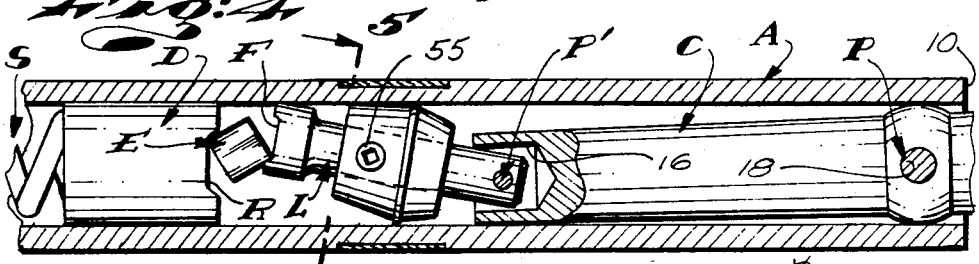
FIG. 4 is an enlarged view of a portion of the structure shown on FIG. 3 with parts in another position.
Figure 5:
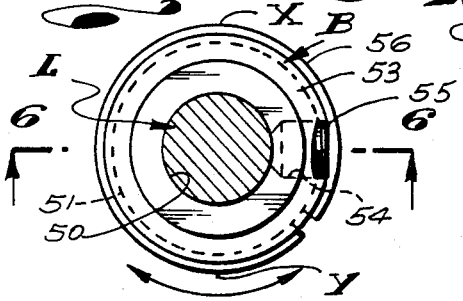
FIG. 5 is an enlarged view taken substantially as indicated by line 5—5 on FIG. 4.

Longitudinal and rotative movement and adjustment of the fulcrum block B on and relative to the link L and the arm A is effected through an access opening 60 (see FIG. 2 of the drawings) in one side of the arm. The opening 60 is located to occur in radial axial alignment with the set screw 55 in the block when the block is in its designed normal position within the construction. The opening 60 is sufficiently large to allow free entry of and Allen wrench into engagement with the screw 55 and for shifting of the block, by manual movement of the wrench, longitudinally and/or circumferentially relative to the arm. Turning of the wrench to advance the screw in or out effects locking and releasing the arm to the link as desired or as circumstances require.

In practice, the access opening 60 is normally covered or closed by a cover band 61 engaged in an annular groove in the exterior of the arm A, as shown in the drawings.

The point of novelty in my invention resides in the angular disposition of the central axis of the bearing surface 56 of the block B relative to the axes of the link L and arm A, which permits or allows for relative longitudinal shifting and adjusting of the diametrically opposite bearing portions X and Y of the surface 56 longitudinally of the link and the arm. The novel end attained by the foregoing is the ability of the wrench structure to be adjusted and set so that it is symmetrical or balanced to operate at the same operating force in both clockwise and counter-clockwise directions.

In the drawings, and to best illustrate the invention, the set screw 53 is shown offset and spaced from the snap ring 56. In practice, the screw 53 occurs on the radial plane of the ring 56 and the gap in the ring is large enough to accommodate the screw. With this relationship of parts, the screw stops rotation of the ring and prevents movement of the gap in the ring to the bearing points X or Y which would interfere with effective functioning of the construction.

Having described only typical preferred forms and applications of my invention, I do not wish to be limited to the specific details herein set forth but wish to reserve to myself any modifications and/or variations that might appear to those skilled in the art and which fall within the scope of the following claims:

Having described my invention, I claim:

1. An adjustable click-type torque wrench structure comprising an elongate, manually engageable tubular arm with a cylindrical interior surface and front and rear ends, an elongate, work-engaging head at the front end of the arm on an axis normal to the axis of the arm, an elongate lever projecting rearwardly from the head and freely into the arm, a first pivot means pivotally connecting the front end portion of the lever to the front end portion of the arm on an axis spaced rearward from and parallel with the axis of the head, an elongate link with front and rear ends positioned freely within the arm, a second pivot means pivotally connecting the front end of the link to the rear end of the lever on an axis parallel with the first pivot means, a rearwardly disposed front cam seat at the rear end of the link, an elongate annular fulcrum block engaged about the link between the ends thereof and shiftable circumferentially and longitudinally relative thereto and having a substantially radially outwardly disposed annular bearing surface with oppositely outwardly disposed work load transmitting sides slidably and pivotally engaging opposing sides of the interior surface of the arm on the central longitudinal radial planes of the link and arm which are normal to the axes of said pins, the radial plane of the annular bearing surface is angularly offset from normal to the central axis of the link at an angle of about 5°, lock means releasably locking the block in set longitudinal and circumferential position on the link, an elongate plunger with front and rear ends in the arm spaced rearward from the link and having a forwardly disposed rear cam seat, a cam block with cam faces normally in bearing engagement with the front and rear cam seats and spring means in the arm rearward of the plunger and yieldingly urging the plunger forward and holding the plunger, cam block and link in pressure engagement with each other; the position of said opposite work load transmitting sides of the annular bearing surface are moved longitudinally in opposite directions relative to the link, arm and to each other by circumferential movement of the block on the link and within the arm.

2. The wrench structure set forth in claim 1 wherein said annular bearing surface is defined by an annular ring engaged in and projecting radially outward from an annular radially outwardly opening groove in said block.

3. The wrench structure set forth in claim 1 wherein said annular bearing surface is defined by an annular ring engaged in and projecting radially outward from an annular radially outwardly opening groove in said block, said lock means includes a set screw carried by the block and engaging the link.

4. The wrench structure set forth in claim 1 wherein said lock means includes a set screw carried by the block and engaging the link.

5. The wrench structure set forth in claim 1 wherein said annular bearing surface is defined by an annular ring engaged in and projecting radially outward from an annular radially outwardly opening groove in said block, said lock means includes a set screw carried by the block and engaging the link, said arm has a radial access opening normally substantially aligned with said set screw.

6. The wrench structure set forth in claim 1 wherein said lock means includes a set screw carried by the block and engaging the link, said arm has a radial access opening normally substantially aligned with said set screw.

* * * * *